US007146311B1

(12) United States Patent
Uvliden et al.

(10) Patent No.: US 7,146,311 B1
(45) Date of Patent: Dec. 5, 2006

(54) CELP ENCODING/DECODING METHOD AND APPARATUS

(75) Inventors: Anders Uvliden, Luleå (SE); Jonas Svedberg, Luleå (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/395,909

(22) Filed: Sep. 14, 1999

(30) Foreign Application Priority Data

Sep. 16, 1998 (SE) ..... 9803164

(51) Int. Cl.
*G10L 19/08* (2006.01)

(52) U.S. Cl. ..... 704/219; 704/220

(58) Field of Classification Search ..... 704/200–201, 704/219–223

See application file for complete search history.

(56) References Cited

U.S. PATENT DOCUMENTS

| | | | | |
|---|---|---|---|---|
| 4,932,061 | A | 6/1990 | Kroon et al. | 381/30 |
| 5,371,853 | A * | 12/1994 | Kao et al. | 704/223 |
| 5,617,145 | A | 4/1997 | Huang et al. | 348/423 |
| 5,754,976 | A * | 5/1998 | Adoul et al. | 704/223 |
| 5,778,335 | A * | 7/1998 | Ubale et al. | 704/219 |
| 5,991,717 | A * | 11/1999 | Minde et al. | 704/203 |
| 6,055,496 | A * | 4/2000 | Heidari et al. | 704/222 |
| 6,122,608 | A * | 9/2000 | McCree | 704/219 |

FOREIGN PATENT DOCUMENTS

| | | |
|---|---|---|
| EP | 0770985 A2 | 5/1997 |
| JP | 05-265496 | 10/1993 |
| WO | WO 95/16260 | 6/1995 |

OTHER PUBLICATIONS

Lin, D., "Ultra-Fast CELP Coding Using Deterministic Multi-Codebook Innovations", 1992, ICASSP, International Conf. on Acoustics, Speech and Signal Processing, vol. 1, pp. 317-320.*

Deller et al, 1987, Discrete-Time Processing of Speech Signals, pp. 480-482.*

Deller et al, 1987, Discrete Time Processing of Speech Signals, pp. 480-482.*

Mano, K. et al., *Design of a Pitch Synchronous Innovation CELP Coder for Mobile Communications*, IEEE Journal on Selected Areas in Communications, vol. 13, No. 1, Jan. 1995, pp. 31-41.

Jeong, J. et al., *Adaptive Huffman Coding of 2-D DCT Coefficients for Image Sequence Compression*, Signal Processing: Image Communication, vol. 7, No. 1, Mar. 1995, pp. 1-11.

McElroy, C. et al., *Wideband Speech Coding Using Multiple Codebooks and Glottal Pulses*, May 1995, IEEE, ICASSAP-95, pp. 253-256.

Ozawa, K. et al., *High Quality Multi-Pulse Based CELP Speech Coding at 6.4 KB/S and Its Subjective Evaluation*, 1998 IEEE, pp. 153-156.

Taniguchi, T. et al.,*Multimode coding: Application to CELP*, May 23-26, 1989, ICASSP-89, vol. 1, Speech Processing1, pp. 156-159.

(Continued)

*Primary Examiner*—Angela Armstrong

(57) ABSTRACT

A multi-codebook fixed bitrate CELP signal block encoder/decoder includes a codebook selector (22) for selecting, for each signal block, a corresponding codebook identification in accordance with a deterministic selection procedure that is independent of signal type. Included are also means for encoding/decoding each signal block by using a codebook having the selected codebook identification.

8 Claims, 3 Drawing Sheets

OTHER PUBLICATIONS

Gjervaldsaeter, P. ; International Search Report on International App. No. PCT/SE99/01432; Mar. 6, 2000, pp. 1-4.
Lange, J.; EPO Standard Search Report; Mar. 31, 1999; File No. RS 101639; pp. 1-2.
Jeong, J., et al.; "Adaptive Huffman Coding of 2-D DCT Coefficients for Image Sequence Compression;" Signal Processing Image Communication, vol. 7, No. 1, Mar. 1995, pp. 1-11.
Taniguchi, T., "Multimode Coding: Application to CELP;" Proceedings of the 1989 IEEE International Conference on Acoustics, Speech and Signal Processing (ICASSP '89); vol. 1, May 23-26, 1989, pp. 156-159, XPOOO89654.
Mano, K., et al.; "Design of a Pitch Synchronous Innovation CELP Coder for Mobile Communications; IEEE Journal on Selected Areas in Communications," vol. 13, No. 1, Jan. 1995, pp. 31-41, XPOOO492743US.
Ozawa, K., et al.; "High Quality Multi-Phase Based CELP Speech Coding at 64KB/S and Its Subjective Evaluation;" Proceedings on the 1998 IEEE International Conference on Acoustics, Speech and Signal Processing (ICASSP '98), vol. 1, May 12-15, 1998, pp. 153-156, XPOO2098717, Seattle, WA.

Sanchez-Calle, V., et al.; "Low-Delay Algebraic CELP Coding of Wideband Speech," Sixth European Signal Processing Conference (EUSIPCO '92)—Signal Processing IV, vol. 1, Aug. 24-27, 1992, pp. 495-498, XPOOO348708, Brussels, BE.

* cited by examiner

CELP ENCODING/DECODING METHOD AND APPARATUS

TECHNICAL FIELD

The present invention relates to a multi-codebook fixed bitrate CELP signal block encoding/decoding method and apparatus and a multi-codebook structure.

BACKGROUND OF THE INVENTION

CELP speech coders typically use codebooks to store excitation vectors that are intended to excite synthesis filters to produce a synthetic speech signal. For high bit rates these codebooks contain a large variety of excitation vectors to cope with a large spectrum of sound types. However, at low bit rates, for example around 4–7 kbits/s, the number of bits available for the codebook index is limited, which means that the number of vectors to choose from must be reduced. Therefore low bit rate coders will have a codebook structure that is compromise between accuracy and richness. Such coders will give fair speech quality for some types of sound and barely acceptable quality for other types of sound.

In order to solve this problem with low bitrate coders a number of multi-mode solutions have been presented [1–5].

References [1–2] describe variable bitrate coding methods that use dynamic bit allocation; where the type of sound to be encoded controls the number of bits that are used for encoding.

References [3–4] describe constant bitrate coding methods that use several equal size codebooks that are optimized for different sound types. The sound type to be encoded controls which codebook is used.

These prior art coding methods all have the drawback that mode information has to be transferred from encoder to decoder in order for the decoder to use the correct decoding mode. Such mode information, however, requires extra bandwidth.

Reference [5] describes a constant bitrate multi-mode coding method that also uses equal size codebooks. In this case an already determined adaptive codebook gain of the previous subframe is used to switch from one coding mode to another coding mode. Since this parameter is transferred from encoder to decoder anyway, no extra mode information is required. This method, however, is sensitive to bit errors in the gain factor caused by the transfer channel.

SUMMARY OF THE INVENTION

An object of the present invention is an encoding/decoding scheme in which coding is improved without the need for explicitly transmitting coding mode information from encoder to decoder.

This object is solved in accordance with the enclosed claims.

Briefly, the present invention achieves the above object by using several different equal size codebooks. Each codebook is weak for some signals, but the other codebooks do not share this weakness for those signals. By deterministically (without regard to signal type) switching between these codebooks from speech block to speech block, the coding quality is improved. There is no need to transfer information on which codebook was selected for a particular speech block, since both encoder and decoder use the same deterministic switching algorithm.

BRIEF DESCRIPTION OF THE DRAWINGS

The invention, together with further objects and advantages thereof, may best be understood by making reference to the following description taken together with the accompanying drawings, in which.

DETAILED DESCRIPTION OF THE PREFERRED EMBODIMENTS

In the following description and in the claims the expression "encoder/decoder" is intended to mean either an encoder or a decoder, since the invention is equally applicable to both cases.

Figure 1:
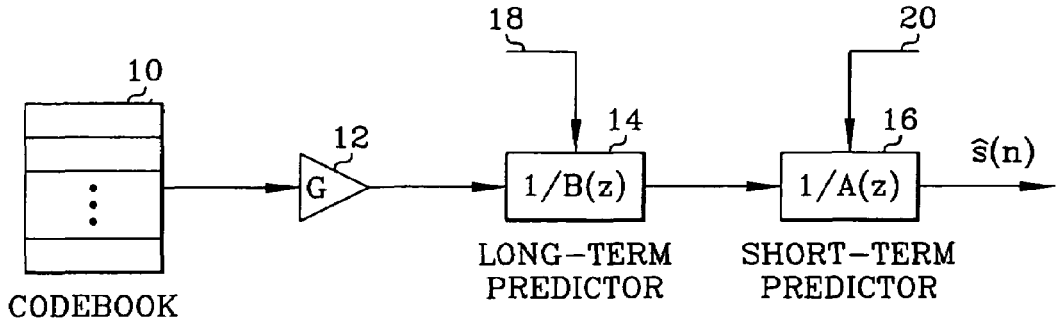
Fig. 1 PRIOR ART
FIG. 1 is a block diagram of the synthesis part of a prior art CELP encoder/decoder.

FIG. 1 is a block diagram of the synthesis part of a prior art CELP (Code Excited Linear Predictive) encoder/decoder. Code vectors selected from a codebook 10 are scaled by a scale factor G in a gain block 12 and forwarded to a long-term predictor 14 and thereafter to a short-term predictor 16. The output signal from short-term predictor 16 is the final synthetic speech signal $\hat{s}(n)$ (prior to possible post processing). Long-term predictor 14 is controlled by control signals on a control line 18, which control signals include a scale factor (gain) and a delay (lag). Similarly short-term predictor 16 is controlled by control signals representing filter coefficients on a control line 20. An encoder determines the control signals on control lines 18, 20 and best codebook vector by a search procedure (analysis-by-synthesis), whereas a decoder determines the same control signals and codebook vector from information received over a transmission channel.

The basic principles of the present invention will now be described with reference to FIGS. 2 and 3.

Figure 2:
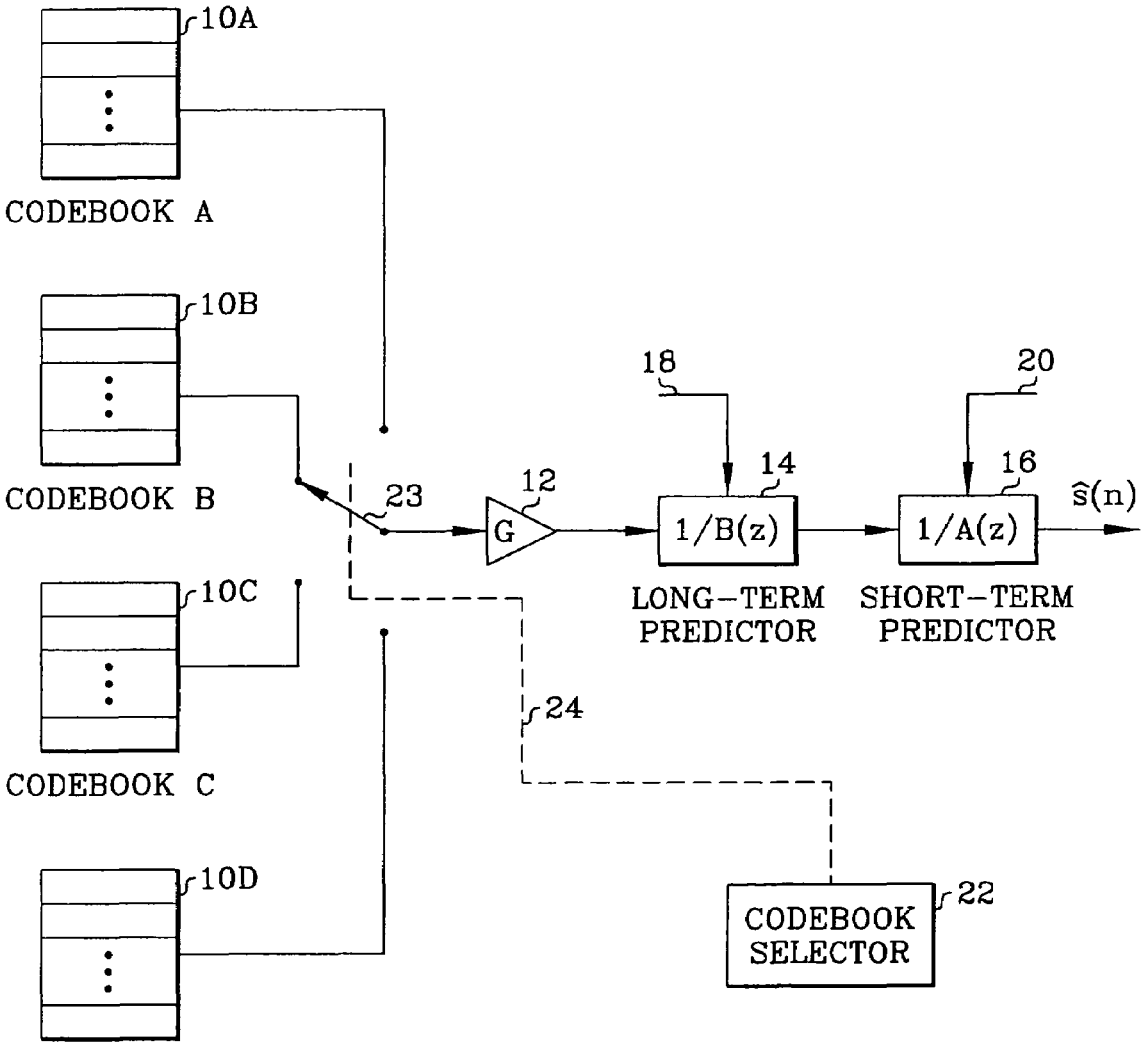
FIG. 2 is a block diagram of the synthesis part of a CELP encoder/decoder in accordance with the present invention.

FIG. 2 is a block diagram of the synthesis part of a CELP encoder/decoder in accordance with the present invention. Elements 12–20 correspond to elements with the same reference designation in the prior art apparatus of FIG. 1. However, instead of providing only one codebook 10 as in FIG. 1, the apparatus of the present invention provides a set of equally sized codebooks 10A–D having equal length vectors. In FIG. 2 there are 4 codebooks, but the number of codebooks in the set may be both larger and smaller than this number. However, the set should at least include 2 codebooks. Since the bitrate is low, each codebook will have some weak points. Therefore the codebooks are designed/trained in such a way that different codebooks in the set do not have the same weak points.

A way of viewing a codebook is to consider it as a multi-dimensional (typically 40-dimensional) "needle cushion", in which the "needles" represent code vectors. In this model an untrained stochastic codebook would be represented by a "hyper-spherical" needle cushion, in which the code vectors are evenly distributed in every "direction" (the codebook is "white"). The training process mentioned above redistributes these vectors in such a way that certain "directions" are more densely populated than other "directions". The least densely populated "directions" correspond to the weak points of the codebook. Each codebook is trained differently in a way that ensures that the codebooks do not have common weak points.

Often a stochastic codebook is approximated by an algebraic codebook, see [6]. Such a codebook may, for example, contain code vectors having a length of 40 samples. However, only very few sample positions actually have values that differ from zero. Furthermore, in many such algebraic codebooks the only allowed values (different from zero) are +1 or −1.

Figure 3:
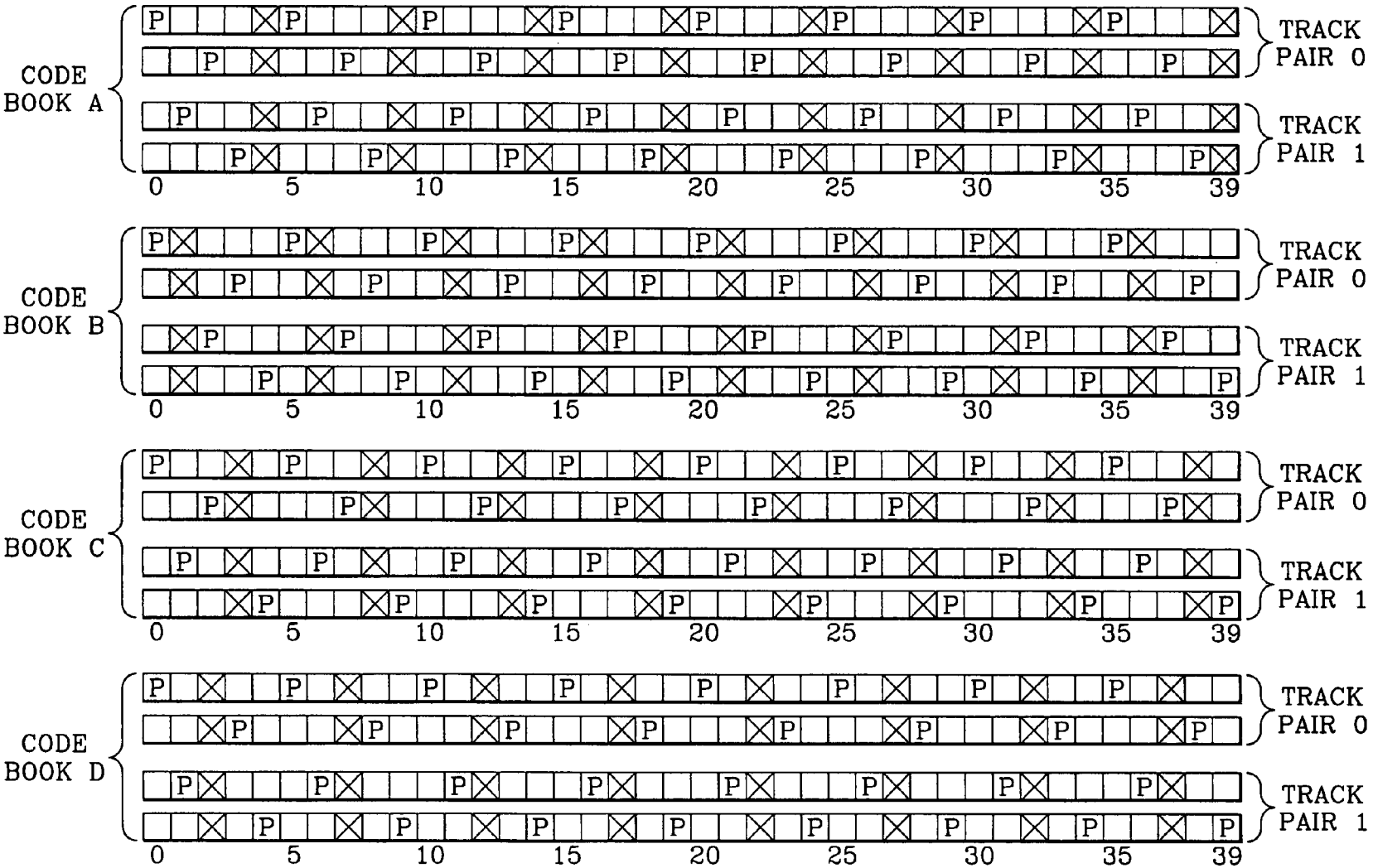
FIG. 3 is a diagram illustrating the structure of 4 different algebraic codebooks that are designed in accordance with a preferred embodiment of the present invention.

FIG. 3 is a diagram illustrating the structure of 4 different algebraic codebooks A–D that are designed in accordance with an examplary embodiment of the present invention. These codebooks have a length of 40 samples and correspond to a 5 ms subframe of speech. Each codebook has 2 track pairs TRACK 0, TRACK 1. Each track has 8 allowed pulse positions P. For example, the second track in the first track pair TRACK 0 in codebook B has allowed pulse positions is sample positions 3, 8, 13, 18, 23, 28, 33, 38. As may be seen from FIG. 3 the other tracks in a codebook have other allowed pulse positions. Furthermore, a track from one codebook may also be found in other codebooks, but in another track. Finally, each codebook has excluded sample positions, which have been crossed out in FIG. 3. These are the "weak points" of the codebook. This codebook structure is summarized in the following table:

Codebook Structure

| Codebook | Track | Track pair 0 | Track pair 1 | Excluded pos. |
|---|---|---|---|---|
| A | 0 | 0 5 10 15 20 25 30 35 | 1 6 11 16 21 26 31 36 | 4 9 14 19 24 |
| | 1 | 2 7 12 17 22 27 32 37 | 3 8 13 18 23 28 33 38 | 29 34 39 |
| B | 0 | 0 5 10 15 20 25 30 35 | 2 7 12 17 22 27 32 37 | 1 6 11 16 21 |
| | 1 | 3 8 13 18 23 28 33 38 | 4 9 14 19 24 29 34 39 | 26 31 36 |
| C | 0 | 0 5 10 15 20 25 30 35 | 1 6 11 16 21 26 31 36 | 3 8 13 18 23 |
| | 1 | 2 7 12 17 22 27 32 37 | 4 9 14 19 24 29 34 39 | 28 33 38 |
| D | 0 | 0 5 10 15 20 25 30 35 | 1 6 11 16 21 26 31 36 | 2 7 12 17 22 |
| | 1 | 3 8 13 18 23 28 33 38 | 4 9 14 19 24 29 34 39 | 27 32 37 |

When one of these codebooks is searched, 1 pulse is positioned in one of the allowed positions of track 0, and 1 pulse is positioned in one of the allowed positions of track 1 of a track pair. This pulse combination is used as a potential code vector group. The group includes 4 possible code vectors, namely 1 vector having 2 positive pules, 1 vector having 2 negative pulses and 2 vectors having 1 positive and 1 negative pulse. By shifting pulse positions within each of the 2 tracks in the track pair it is possible to form other such code vector groups. The same principles apply to track pair 1. By testing each possible combination the best code vector is selected. This code vector is defined by its corresponding track pair, 2 pulse positions in the tracks of this pair, and the pulse signs. This requires 1 bit to specify track pair, 2·3=6 bits to specify pulse positions (there are 8 positions in a track, which requires 3 bits) in the tracks of this pair, and 2 bits to specify the sign of each pulse. Thus, a total of 9 bits defines a code vector.

Returning to FIG. 2, a codebook selector 22 selects one of the codebooks in the set for encoding/decoding a signal block, for example a speech frame or subframe (typically a block has a length of 5–10 ms). This is done by controlling a switch 23 with a control signal on a control line 24. Switch 23 is controlled in accordance with a deterministic selection procedure that is independent of signal type. Here "deterministic" means that codebook selector 22 selects codebooks from the set for encoding/decoding of each signal block, but does this without any knowledge of signal type, and that the selection algorithm is the same for both encoder and decoder and does not have to be transferred from encoder to decoder. The encoder determines the best vector from the selected codebook in accordance with the above mentioned search procedure, whereas the decoder selects the corresponding vector in the same codebook by using the received "index" (code vector identifier).

The codebooks 10A–D all have the same bitrate, their weakest performance points are not shared. By deterministically switching between the codebooks from signal block to signal block, the deficiencies of each codebook will be compensated over time. It has been found that the average perceived sound quality of the encoded and thereafter decoded audio signals actually increases in spite of the fact that signal type is disregarded in the switching algorithm. This may be explained by noting that the resulting distortion from one single codebook is not repeated in every subframe or block. Instead the varying distortions will be smoothed out. Thus, the distortion from this low bitrate (multi) codebook is perceived less annoying, since it is not continuously repeated.

One embodiment of the selection algorithm is to sequentially and cyclically select each codebook 10A–D. The encoder and decoder are automatically in sync if the number of codebooks corresponds to the number of subframes in a frame and a codebook counter in encoder and decoder is reset every frame. Otherwise synchronization may be achieved by resetting a modulo n counter, where n is the number of codebooks, in both encoder and decoder at call-setup and handover.

Another selection algorithm is to use a pseudo-random sequence to select codebooks from the set. In this case the seed of the algorithm that generates the pseudo-random sequence is known to both encoder and decoder. Synchronization between encoder and decoder may, for example, be achieved by a pseudo random sequence that is based on transmitted and received frame parameters that are determined and analyzed prior to the codebook search.

Figure 4:
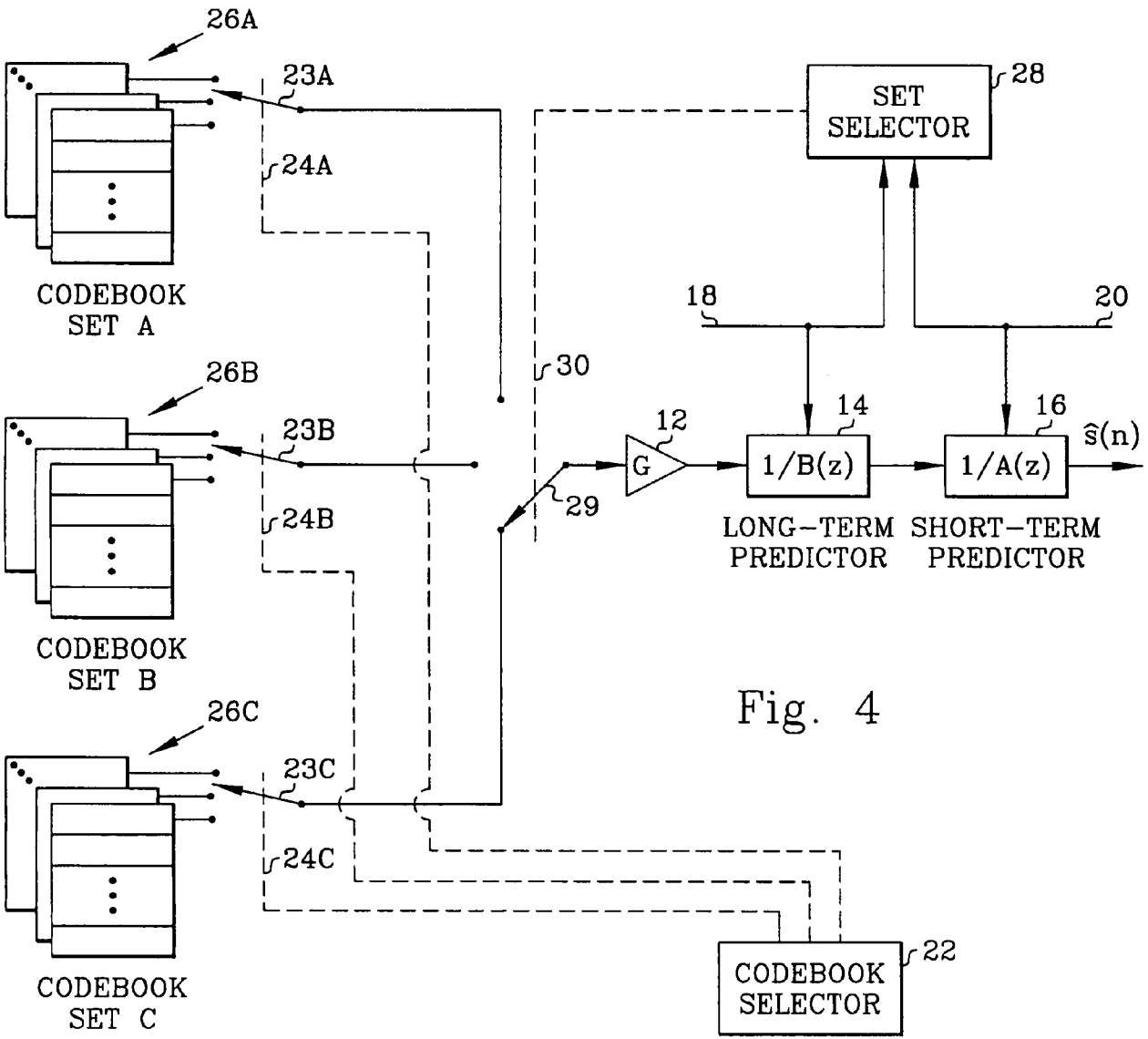
FIG. 4 is a block diagram of the synthesis part of another CELP encoder/decoder in accordance with the present invention.

FIG. 4 is a block diagram of the synthesis part of another CELP encoder/decoder in accordance with the present invention. This embodiment is similar to the embodiment of FIG. 2, but in this case there are several sets 26A–C of codebooks. Each set contains codebooks that do not share the same weak points, just as in FIG. 2, but each set is also designed to cope with different environments, for example different signal types or levels of background sounds. The design of each set may be performed, for example, in accordance with the principles described in [5]. FIG. 4 illustrates 3 sets of codebooks, but 2 or more than 3 sets are also possible.

As in FIG. 2 a codebook is deterministically selected for each signal block, in this embodiment over switches 23A–C and control lines 24A–C. However, before a codebook is selected from a set, a set selector 28 determines which set to use over a switch 29 and a control line 30. Set selector 28 bases its selection on information contained in the other, previously determined, parameters on lines 18, 20 and in gain element 12. This information may, for example, be determined from the LPC (Linear Predictive Coding) or LTP (Long Term Predictor) parameters or from a combination of LPC and LTP parameters. For example, detected stationarity of LTP parameters may be used to indicate signal type.

Due to the fact that the parameters that are used for set selection will be transferred from encoder to decoder anyway, no bandwidth is lost for transferring set selection information. Preferably only channel protected parameters are used for set detection. Furthermore, an especially preferred embodiment of the encoder/decoder of FIG. 4 uses only the parts of the channel protected parameters that have error detection to determine the codebook set to use. For example, in the GSM system 6 of the 9 lag bits and 3 of the 4 gain bits of the LTP parameters are provided with error detection. Preferably these bits ate used to test stationarity (over, say, 20 ms) to determine codebook set.

Since the set selection precedes the codebook selection, the embodiment of FIG. 4 allows for a different number of codebooks in each set 26A–C. This requires a separate control line for each switch 23A–C and a separate switching algorithm in codebook selector 22 for each set. If all sets have the same number of codebooks, a common control line for all the switches may be used. Furthermore, this embodiment allows for the possibility of reversing the set and codebook selections (if allowed by causality considerations).

Typically the functionality of set and codebook selectors 22, 28 is implemented by one or several micro processors or micro/signal processor combinations.

Figure 5:
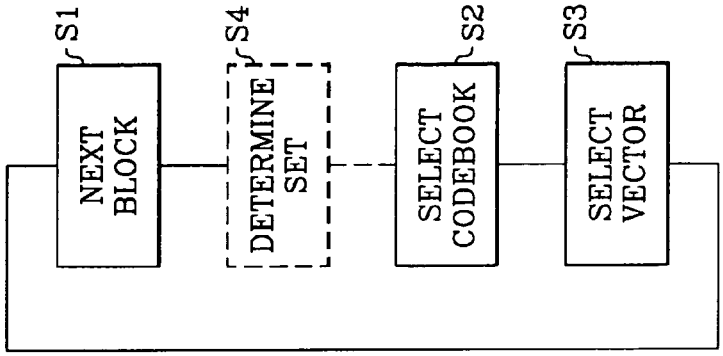
FIG. 5 is a flow chart illustrating the CELP encoding/decoding method of the present invention.

FIG. 5 is a flow chart illustrating the CELP encoding/decoding method of the present invention. The method starts in step S1 by selecting the next block to be encoded/decoded. Step S2 selects a codebook number in accordance with a deterministic selection algorithm. Step S3 selects/retrieves the best vector from the selected codebook. Thereafter the procedure loops back to step S1. If several codebook sets are used, as in the embodiment of FIG. 3, there will be an extra step S4 (shown with dashed lines in FIG. 5) that determines the proper codebook set. This step S4 may precede or follow after (if allowed by causality considerations) step S2.

It will be understood by those skilled in the art that various modifications and changes may be made to the present invention without departure from the scope thereof, which is defined by the appended claims.

REFERENCES

[1] M. Yong and A. Gersho, "Vector Excitation Coding with Dynamic Bit Allocation", Proc. GLOBCOM, pp 290–294, December 1988.

[2] N. S. Jayant and J. H. Chen, "Speech Coding with Time-Varying Bit Allocation to Excitation and LPC Parameters", Proc. ICASSP, pp 65–68, May 1989.

[3] T. Taniguchi et al, "Multimode Coding: Application to CELP", Proc. ICASSP, pp 156–159, May 1989.

[4] M. Akamine and K. Miseki, "CELP Coding with an Adaptive Density Pulse Excitation Model", Proc. ICASSP, pp 29–32, 1990.

[5] K. Ozawa and M. Serizawa, "High Quality Multi-Pulse Based CELP Speech Coding at 6.4 kb/s and its Subjective Evaluation", Proc. ICASSP, pp 153–156, 1998.

[6] J-P Adoul et al, "Fast CELP Coding Based on Algebraic Codes", Proc. ICASSP, pp 1957–1960, 1987.

The invention claimed is:

1. A method of encoding a speech signal utilizing CELP speech encoding, said method comprising:

receiving a plurality of unencoded speech signal blocks in a CELP speech encoder; and encoding the speech signal blocks utilizing a multi-codebook fixed bitrate CELP signal block encoding process, said encoding step including the steps of:

cyclically generating a sequence of excitation codebook identifications;

accessing the cyclically generated sequence of excitation codebook identifications;

identifying, for each signal block of the plurality of unencoded signal blocks, a corresponding excitation codebook identification from said cyclically generated sequence of excitation codebook identifications; and encoding each signal block by using an excitation codebook corresponding to said identified excitation codebook identification;

wherein said identifying step is defined by stepping through each excitation codebook identification of said cyclically generated sequence of excitation codebook identifications, each excitation codebook identification corresponding to one excitation codebook of a plurality of excitation codebooks.

2. A method of encoding a speech signal utilizing CELP speech encoding, said method comprising:

receiving a plurality of unencoded speech signal blocks in a CELP speech encoder; and encoding the speech signal blocks utilizing a multi-codebook fixed bitrate CELP signal block encoding process, said encoding step including the steps of:

pseudo-randomly generating a sequence of excitation codebook identifications;

accessing the pseudo-randomly generated sequence of excitation codebook identifications;

identifying, for each signal block of the plurality of unencoded signal blocks, a corresponding excitation codebook identification from said pseudo-randomly generated sequence of excitation codebook identifications; and encoding each signal block by using an excitation codebook corresponding to said identified excitation codebook identification;

wherein said identifying step is defined by stepping through each excitation codebook identification of said pseudo-randomly generated sequence of excitation codebook identifications, each excitation codebook identification corresponding to one excitation codebook of a plurality of excitation codebooks.

3. A method of decoding a speech signal utilizing CELP speech decoding, said method comprising:

receiving a plurality of encoded speech signal blocks in a CELP speech decoder; and decoding the speech signal blocks utilizing a multi-codebook fixed bitrate CELP signal block decoding process, said decoding step including the steps of:

cyclically generating a sequence of excitation codebook identifications;

accessing the cyclically generated sequence of excitation codebook identifications;

identifying, for each signal block of the plurality of encoded signal blocks, a corresponding excitation codebook identification from said cyclically generated sequence of excitation codebook identifications; and decoding each encoded signal block by using an excitation codebook corresponding to said identified excitation codebook identification;

wherein said identifying step is defined by stepping through each excitation codebook identification of said cyclically generated sequence of excitation codebook identifications, each excitation codebook identification corresponding to one excitation codebook of a plurality of excitation codebooks.

4. A method of decoding a speech signal utilizing CELP speech decoding, said method comprising:

receiving a plurality of encoded speech signal blocks in a CELP speech decoder; and decoding the speech signal blocks utilizing a multi-codebook fixed bitrate CELP signal block decoding process, said decoding step including the steps of:

pseudo-randomly generating a sequence of excitation codebook identifications;

accessing the pseudo-randomly generated sequence of excitation codebook identifications;

identifying, for each signal block of the plurality of encoded signal blocks, a corresponding excitation codebook identification from said pseudo-randomly generated sequence of excitation codebook identifications; and decoding each encoded signal block by using an excitation codebook corresponding to said identified excitation codebook identification;

wherein said identifying step is defined by stepping through each excitation codebook identification of said pseudo-randomly generated sequence of excitation codebook identifications, each excitation codebook identification corresponding to one excitation codebook of a plurality of excitation codebooks.

5. A CELP speech encoder, comprising:

means for receiving a plurality of unencoded speech signal blocks; and a multi-codebook fixed bitrate CELP signal block encoding circuit for encoding the speech signal blocks, said circuit comprising:

means for cyclically generating a sequence of excitation codebook identifications;

means for accessing the cyclically sequence of excitation codebook identifications;

means for identifying, for each signal block of the plurality of unencoded signal blocks, a corresponding excitation codebook identification from said cyclically generated sequence of excitation codebook identifications; and means for encoding each signal block by using an excitation codebook corresponding to said identified excitation codebook identification;

wherein said cyclically generated sequence of excitation codebook identifications comprises a plurality of different excitation codebook identifications, each excitation codebook identification of said plurality of different excitation codebook identifications corresponding to one excitation codebook of a plurality of different excitation codebooks.

6. A CELP speech decoder, comprising:

means for receiving a plurality of encoded speech signal blocks; and a multi-codebook fixed bitrate CELP signal block decoding circuit for decoding the speech signal blocks, said circuit comprising:

means for cyclically generating a sequence of excitation codebook identifications;

means for accessing the cyclically sequence of excitation codebook identifications;

means for identifying, for each signal block of the plurality of encoded signal blocks, a corresponding excitation codebook identification from said cyclically generated sequence of excitation codebook identifications; and means for decoding each encoded signal block by using an excitation codebook corresponding to said identified excitation codebook identification;

wherein said cyclically generated sequence of excitation codebook identifications comprises a plurality of different excitation codebook identifications, each excitation codebook identification of said plurality of different excitation codebook identifications corresponding to one excitation codebook of a plurality of different excitation codebooks.

7. A CELP speech encoder, comprising:

means for receiving a plurality of unencoded speech signal blocks; and a multi-codebook fixed bitrate CELP signal block encoding circuit for encoding the speech signal blocks, said circuit comprising:

means for pseudo-randomly generating a sequence of excitation codebook identifications;

means for accessing the pseudo-randomly generated sequence of excitation codebook identifications;

means for identifying, for each signal block of the plurality of unencoded signal blocks, a corresponding excitation codebook identification from said pseudo-randomly generated sequence of excitation codebook identifications; and means for encoding each signal block by using an excitation codebook corresponding to said identified excitation codebook identification;

wherein said pseudo-randomly generated sequence of excitation codebook identifications comprises a plurality of different excitation codebook identifications, each excitation codebook identification of said plurality of different excitation codebook identifications corresponding to one excitation codebook of a plurality of different excitation codebooks.

8. A CELP speech decoder, comprising:

means for receiving a plurality of encoded speech signal blocks; and a multi-codebook fixed bitrate CELP signal block decoding circuit for decoding the speech signal blocks, said circuit comprising:

means for pseudo-randomly generating a sequence of excitation codebook identifications;

means for accessing the pseudo-randomly generated sequence of excitation codebook identifications;

means for identifying, for each signal block of the plurality of encoded signal blocks, a corresponding excitation codebook identification from said cyclically generated sequence of excitation codebook identifications; and means for decoding each encoded signal block by using an excitation codebook corresponding to said identified excitation codebook identification;

wherein said pseudo-randomly generated sequence of excitation codebook identifications comprises a plurality of different excitation codebook identifications, each excitation codebook identification of said plurality of different excitation codebook identifications corresponding to one excitation codebook of a plurality of different excitation codebooks.

* * * * *